US006606808B2

(12) United States Patent
Katz

(10) Patent No.: US 6,606,808 B2
(45) Date of Patent: Aug. 19, 2003

(54) EXIT SIGN WITH ROTATABLE LIGHTING HEADS

(75) Inventor: Jeffrey S. Katz, Pickerington, OH (US)

(73) Assignee: Best Lighting Products, Inc., Reynoldsburg, OH (US)

( * ) Notice: Subject to any disclaimer, the term of this patent is extended or adjusted under 35 U.S.C. 154(b) by 80 days.

(21) Appl. No.: 09/813,840

(22) Filed: Mar. 22, 2001

(65) Prior Publication Data

US 2001/0045035 A1 Nov. 29, 2001

Related U.S. Application Data

(60) Provisional application No. 60/192,620, filed on Mar. 24, 2000.

(51) Int. Cl.[7] ..... G09F 13/06; F21V 21/29

(52) U.S. Cl. ..... 40/570; 40/546; 40/564; 362/287; 362/234

(58) Field of Search ..... 40/570, 546, 580, 40/564; 362/287, 427, 812, 234, 147, 404

(56) References Cited

U.S. PATENT DOCUMENTS

| | | | | | |
|---|---|---|---|---|---|
| 1,500,998 | A | * | 7/1924 | Kuhn | 40/573 |
| 2,152,844 | A | * | 4/1939 | Hays | 40/577 |
| 3,916,404 | A | | 10/1975 | Gouge | |
| 4,075,470 | A | * | 2/1978 | Moore | 362/287 |
| 4,380,792 | A | * | 4/1983 | Terrell | 362/250 |
| 4,531,114 | A | | 7/1985 | Topol et al. | |
| 4,535,391 | A | | 8/1985 | Hsiao | |
| 5,448,843 | A | | 9/1995 | Schwartz | |
| 5,599,089 | A | * | 2/1997 | Sheu et al. | 362/198 |
| D379,373 | S | | 5/1997 | Logan et al. | |
| 5,697,175 | A | | 12/1997 | Schwartz | |
| 5,713,662 | A | * | 2/1998 | Kira | 362/427 |
| D391,992 | S | | 3/1998 | Vosika et al. | |
| 5,797,673 | A | * | 8/1998 | Logan et al. | 362/234 |
| 5,941,630 | A | * | 8/1999 | Finke et al. | 362/371 |
| 6,059,429 | A | * | 5/2000 | Bodell | 362/287 |
| 6,142,648 | A | | 11/2000 | Logan et al. | |
| 6,193,395 | B1 | * | 2/2001 | Logan | 362/285 |
| 6,309,085 | B1 | * | 10/2001 | Katz et al. | 362/234 |

OTHER PUBLICATIONS

Lithonia Lighting: Quantum Emergency Lighting Exit Signs and Emergency Units, Form 680.181, Jun. 1999.

* cited by examiner

*Primary Examiner*—Stephen T. Gordon
*Assistant Examiner*—Gregory Blankenship
(74) *Attorney, Agent, or Firm*—Diederiks & Whitelaw, PLC

(57) ABSTRACT

An emergency exit sign includes a support assembly which permits rotation of lighting heads, about an upright axis, through an angle greater than 180°. A freely rotatable joint element is used to maintain the lighting heads, in cooperation with mating facets, in various positions without the need for mechanical fasteners. The lighting heads are also attached to a snap connector which, enables the lighting head to be shifted about an arcuate axis, as well as rotated about a still further axis which is substantially perpendicular to the upright axis.

14 Claims, 6 Drawing Sheets

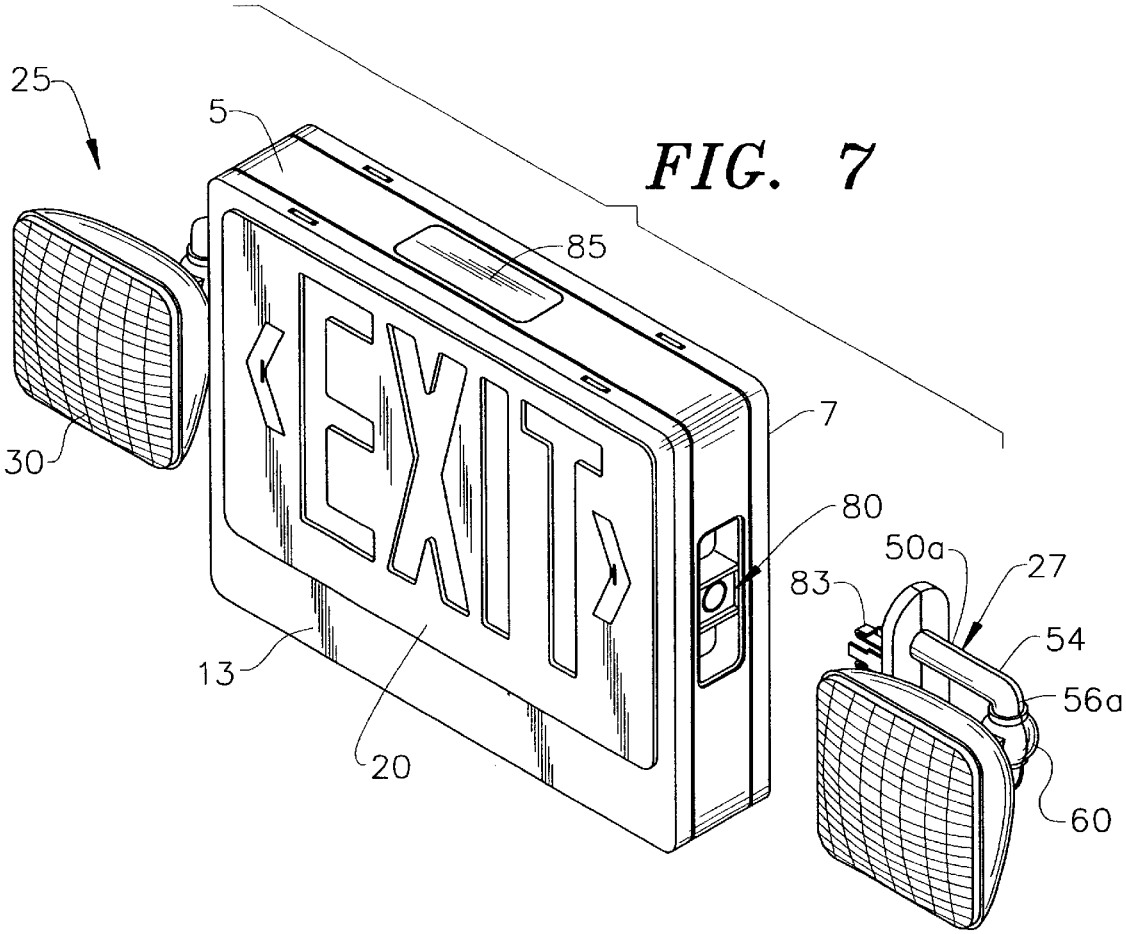
FIG. 7
FIG. 8
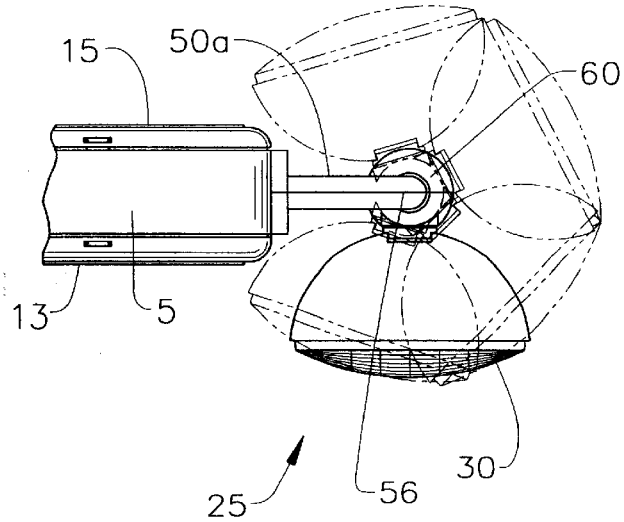
FIG. 9
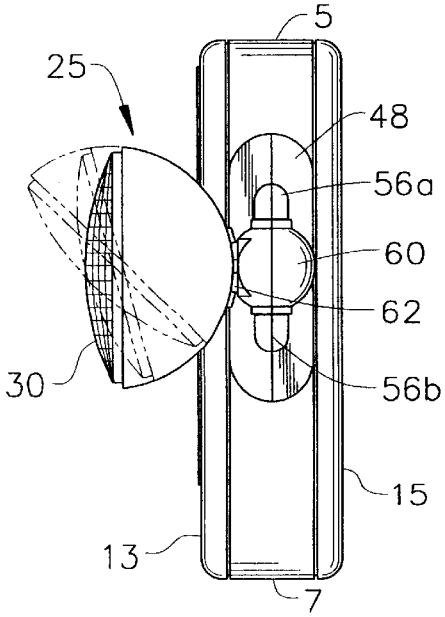

EXIT SIGN WITH ROTATABLE LIGHTING HEADS

This application claims the benefit of U.S. Provisional 60/192,620 filed Mar. 24, 2000.

BACKGROUND OF THE INVENTION

1. Field of the Invention

The present invention pertains to the art of exit signs and, more particularly, to an exit sign which is adapted to be mounted above a doorway and incorporates at least one lighting head that can be rotated and angled into a variety of positions relative to a housing of the exit sign.

2. Discussion of the Prior Art

Exit signs are commonly found in essentially all commercial buildings. In general, the purpose of an exit sign is to direct a person's attention to the location of a suitable building exit. To achieve this function, it is known to provide exit signs along corridors in order to lead one to an exit, as well as directly adjacent the exit itself. Typically, such exit signs are mounted on surrounding walls or suspended from a ceiling. In any case, exit signs mark the way for people leaving a building.

In the event of an emergency, such as a building fire, exit signs can play a crucial role in enabling people to safely leave the building in a timely manner. Typically, an audible fire alarm is sounded as an initial indicator of the presence for possibility of a fire. In addition, strobe lights are also often used as visual indicators in such emergency situations, especially in large scale commercial buildings such as hotels, hospitals, convention centers, large office buildings and the like. Furthermore, it is known in the art to provide auxiliary lighting heads on the housing of an exit sign in order to illuminate the area leading to and around the exit.

In accordance with the prior art, such lighting heads have either been fixed in a certain position relative to the housing of the exit sign or permitted to be adjusted to some limited extent. Often, such adjustments require the loosening of a threaded or other type of fastener, an adjustment of the lighting head and then a re-tightening of the fastener. On the other hand, there has been some proposals to provide for certain directional adjustments for the lighting heads relative to the exit housing which do not require the loosening and tightening of mechanical fasteners. However, with such known arrangements, such adjustments are either time consuming or limited in range.

Based on the above, there exists a need in the art for a versatile exit sign incorporating one or more lighting heads wherein each lighting head can be readily repositioned relative to the housing of the exit sign about numerous axes such that the most advantageous lighting configuration can be readily accomplished with minimal effort.

SUMMARY OF THE INVENTION

In accordance with the present invention, an exit sign includes a housing provided with wall portions to which one or more lighting heads are attached. In accordance with the most preferred embodiment, a pair of lighting heads are attached to spaced lateral side wall portions of the exit housing. The lighting heads are snap-fit into recessed areas formed in the housing and include a base from which project upper and lower support arms. Each support arm includes an elongated laterally extending portion which leads to a generally vertically extending portion. Each vertically extending portion has a terminal end formed with a plurality of external facets. Interposed between the support arms is a joint element including a pair of opposing aligned holes which are also, preferably, faceted.

With this arrangement, the joint element can be rotated about a substantially vertical axis relative to the support arms. During rotation, the facets of the arms and the joint element interact to define a plurality of detent positions for the joint element. A lighting head is rotatably mounted about a substantially horizontal axis to the joint element at a position defined between the upper and lower openings of the joint element. Most preferably, the joint element is provided with an additional opening that opens laterally of the element and the light head is provided with a connector which is snap-fit into the joint element. With this arrangement, the lighting head can be rotated about a substantially vertical axis defined by the support arms through an angle greater than 180° relative to the exit sign housing, while also being rotatable about a substantially horizontal axis through 360°. Electrical wires for the lighting head extend through the snap connector, into the joint element, through one of the upper and lower support arms and into the exit housing, thereby supplying power to the lighting head. To further enhance the ability to position the lighting head in a desired orientation, the head is formed with an elongated recess into which the snap connector is slidably received such that the lighting head can be angled relative to the snap connector and the joint element by shifting of the lighting head, wherein the snap connector slides within and becomes repositioned within the elongated recess. Due to the configuration of the lighting head, the recess essentially constitutes and defines an arcuate path that extends from one side of the lighting unit, approximately two thirds the way across to an opposing side of the unit.

With this configuration, the lighting heads can be maneuvered in essentially any desired position and along multiple axes. That is, the lighting head can be rotated through more than 180° about a vertical axis defined by the support arms, can be rotated about the substantially horizontal axis through the connection of the lighting head to the joint element and the lighting head can be repositioned relative to each of the snap connector, joint element and support arms through the interconnection between the snap connector and the lighting head.

Additional objects, features and advantages of the present invention would be readily apparent to one of ordinary skill in the art, particularly when taken in conjunction with the drawings presented herewith.

BRIEF DESCRIPTION OF THE DRAWINGS

FIG. 7 is a perspective view of the exit sign of FIGS. 1–6 with one of the rotatable lighting heads shown exploded from the main housing of the exit sign;

FIG. 8 illustrates the repositioning of one of the lighting heads about one axis;

FIG. 9 illustrates the manner in which the angle of the lighting head with respect to a horizontal axis can be adjusted;

DETAILED DESCRIPTION OF THE PREFERRED EMBODIMENT

Figure 1:
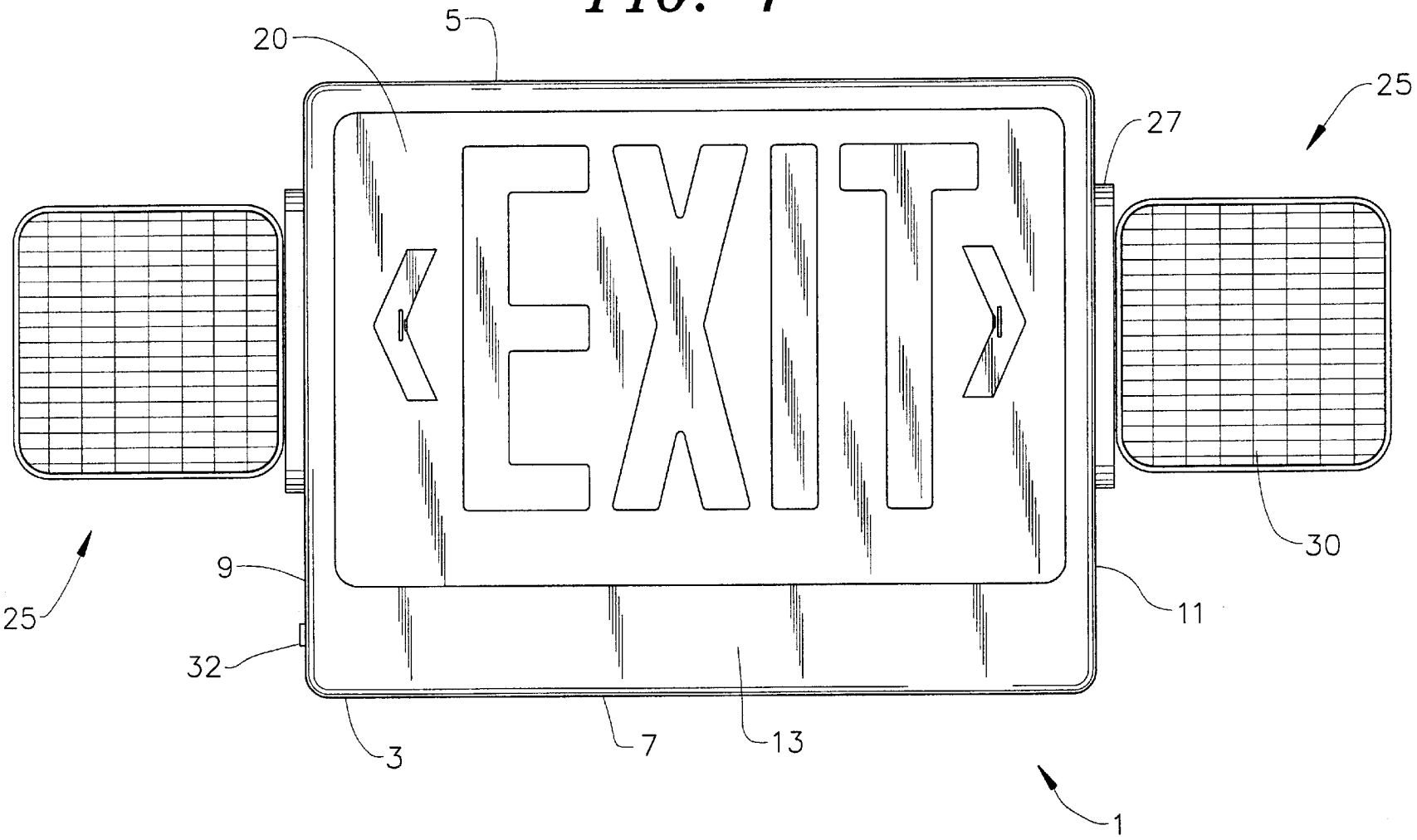
FIG. 1 is a front elevational view of an exit sign, incorporating a pair of laterally spaced adjustable lighting heads, constructed in accordance with the present invention.

With initial reference to FIG. 1, an exit sign constructed in accordance with the invention is generally indicated at 1. Exit sign 1 includes a housing 3 having a top 5, a bottom 7, a left lateral side 9, a right lateral side 11, a substantially planar front surface 13 and a planar rear surface 15 (shown in FIG. 2). In the preferred embodiment, first surface 13 exhibits letters/symbols 20. Although letters/symbols 20 are shown in FIG. 1 expressing the word EXIT, with chevrons on either side of this term, it is considered within the scope of this invention that any combination of letters or symbols may be expressed on front surface 13 or, in fact, rear surface 15.

A lighting system (not shown) is located within housing 3 and may be constituted by any conventional illumination system to light up letters/symbols 20. For example, the lighting system may simply include a single light bulb centrally located within housing 3 to shine through partially transparent or translucent letters/symbols 20. In an alternative, the lighting system may include a separate incandescent light bulb for each of the individual symbols of letters/symbols 20. The lighting system may also include a series of LEDs forming the individual symbols of letters/symbols 20, as commonly known in the art. In a manner also known in the art, exit sign 1 is adapted to be connected to a primary power source (not shown), e.g. AC, and a secondary power source, e.g. an internal battery, for when the primary power source fails. However, the power sources and specific lighting system within housing 3 do not form part of the present invention.

FIG. 1 also shows two lighting heads 25 mounted to housing 3. Specifically, each lighting head 25 is affixed to a support assembly 27, which is attached to a respective one of lateral sides 9 and 11 of housing 3, as will be more fully described below with reference to FIGS. 2–11. Each lighting head 25 is shown as including a lens 30, behind which is preferably located a typical flood light bulb used in emergency lighting systems. Again, any conventional lighting apparatus may be used. A button 32 protrudes from left lateral side 9 and is electrically connected to a fuse or other circuitry used with exit side 1.

Figure 2:
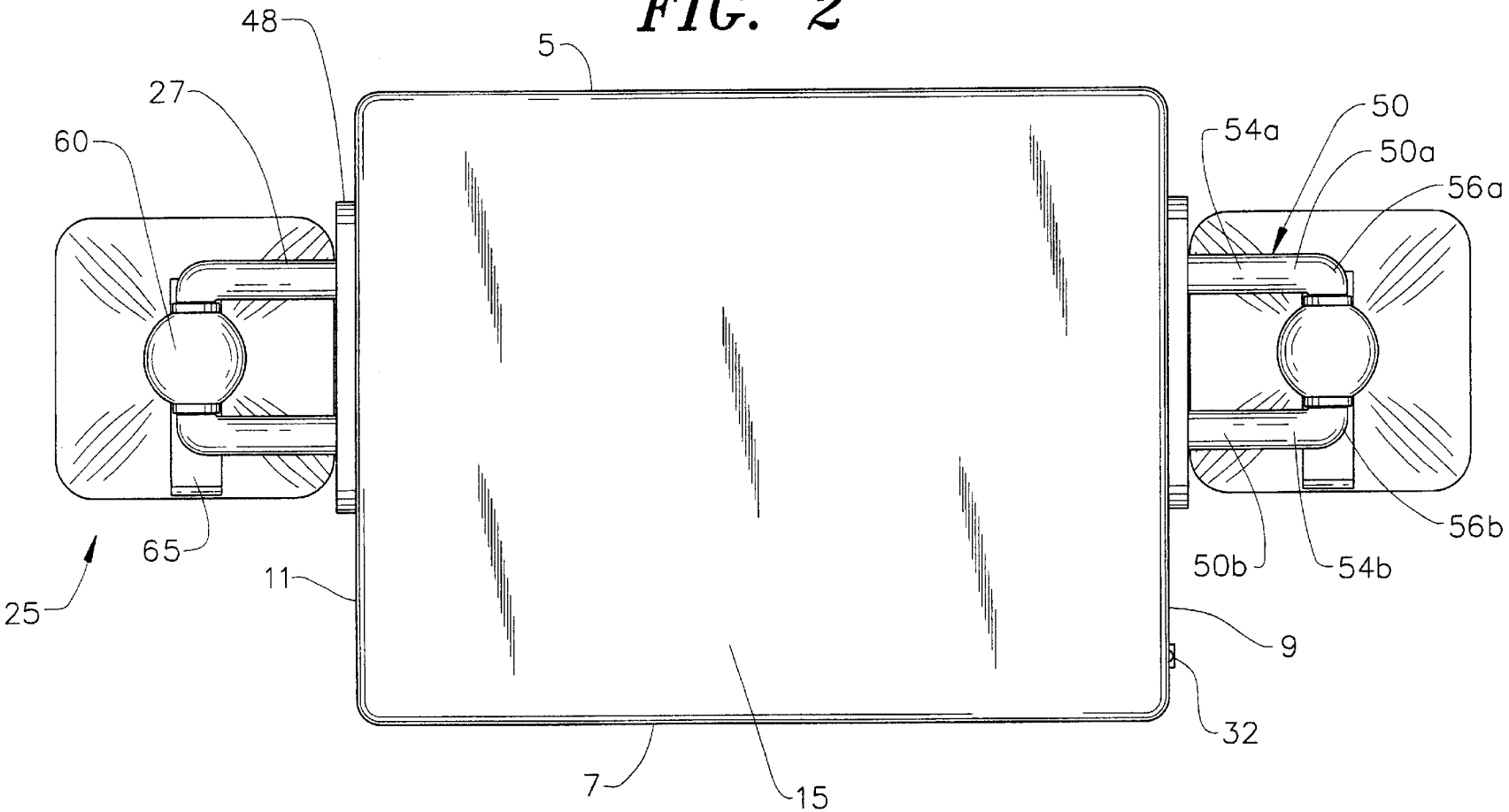
FIG. 2 is a rear elevational view of the exit sign of FIG. 1.

FIG. 2 shows exit sign 1 with rear surface 15 exposed. Because letters/symbols 20 are only on front surface 13, letters/symbols 20 are not shown in FIG. 2. However, as indicated above, it is considered within the scope of this invention to incorporate letters/symbols in rear surface 15 as well. Although two support assemblies 27 are shown to extend from housing 3, each support assembly 27 is preferably identical in construction and, as such, a detailed description of one of support assembly 27 will be provided below and it to be understood that each support assembly has the equivalent structure.

Support assembly 27 is used to connect a respective lighting head 25 to housing 3. A mounting flange 48 of support assembly abuts right lateral side 9 and functions, in conjunction with structure to be later defined, to secure support assembly 27 to housing 3. Mounting flange 48 is essentially a planar member from which extends a support arm assembly 50. In a preferred embodiment, an upper support arm 50*a* and a lower support arm 50*b* are provided. Each support arm 50*a*, 50*b* includes a respective laterally extending portion 54*a*, 54*b* which begins at mounting flange 48 and proceeds perpendicularly for a distance until forming a vertically extending portion 56*a*, 56*b*. Because the angle formed between laterally extending portions 54*a*, 54*b* and vertically extending portions 56*a*, 56*b* are right angles, vertically extending portions 56*a*, 56*b* are arranged parallel to mounting flange 48. As shown, vertically extending portions 56*a*, 56*b* extend from laterally extending portions 54*a*, 54*b* and point towards each other. Specifically, vertically extending portion 56*a* begins at the end of laterally extending portion 54*a*, opposite mounting flange 48 and extends toward opposite vertically extending portion 56*b*. Similarly, vertically extending portion 56*b* begins at the end of laterally extending portion 54*b*, opposite mounting flange 48, and extends toward opposite vertically extending portion 56*a*.

A joint element 60 connects upper support arm 50*a*, lower support arm 50*b* and lighting head 25. A snap connector 62 (shown in FIGS. 3–6 and 11) is inserted into an elongated recess 65 in lighting head 25. Because the surface of lighting head 25 is curved, elongated recess 25 defines an arcuate path that extends from one side of lighting head 25, approximately two-thirds the way across to an opposing side of lighting head 25. The combination of snap connector 62 in elongated recess 65 and joint element 60 linking upper support arm 50*a* with lower support arm 50*b* permits rotation of lighting head 25 into a variety positions, as will be more fully described below. Additionally, the construction of snap connector 62 allows for lighting head 25 to be rotated in a plane defined by lens 30.

Figure 3:
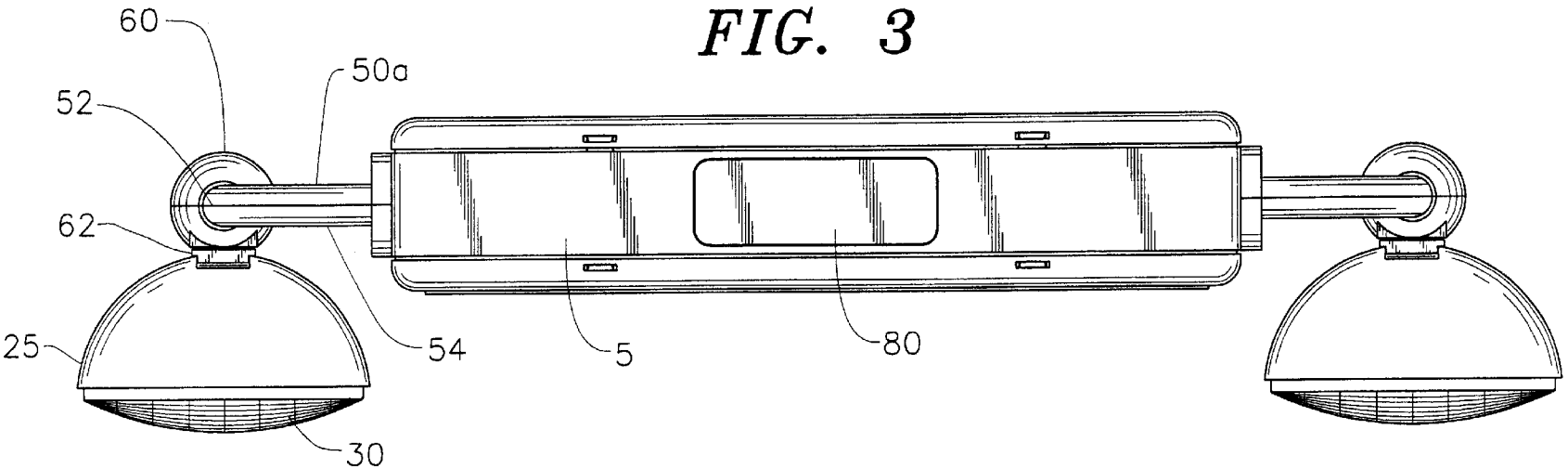
FIG. 3 is a top plan view of the exit sign.
Figure 4:
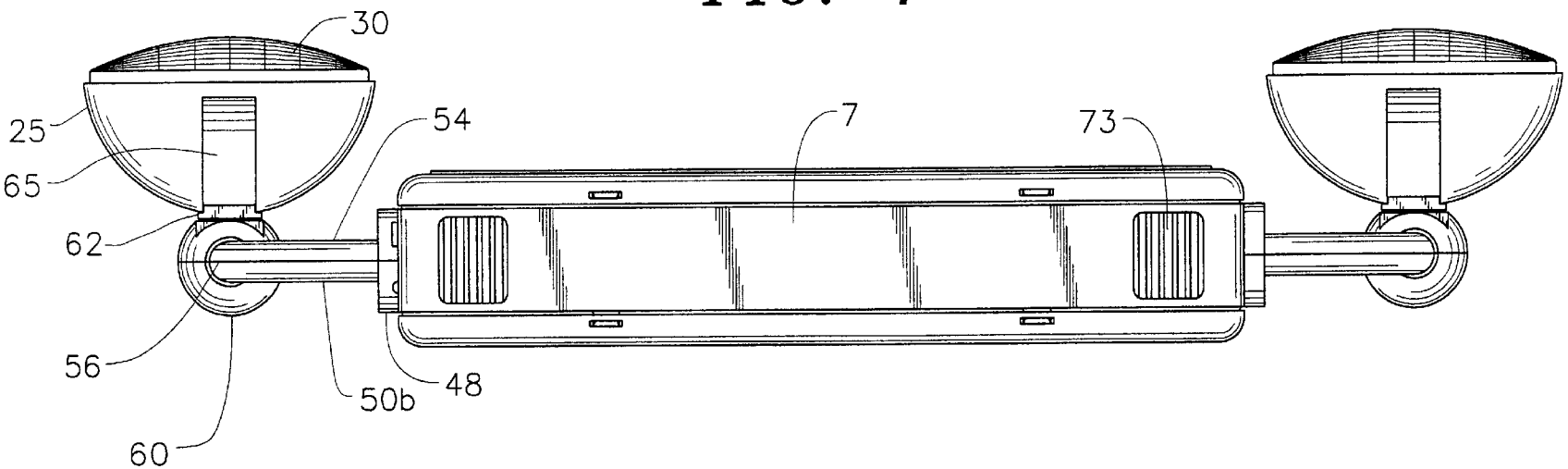
FIG. 4 is a bottom plan view of the exit sign.

FIGS. 3 and 4 show exit sign 1 from a top plan view and a bottom plan view, respectively, with lighting heads 25 in identical positions. Indicated at 73 is a vent, for allowing air to enter housing 3 to cool the included lighting system. Snap connector 62 can also be seen inside elongated recess 65. The configuration of elongated recess 65 within lighting head 25 is more clearly shown in FIG. 4 as forming its arcuate path for adjustment of lighting head 25.

Figure 5:
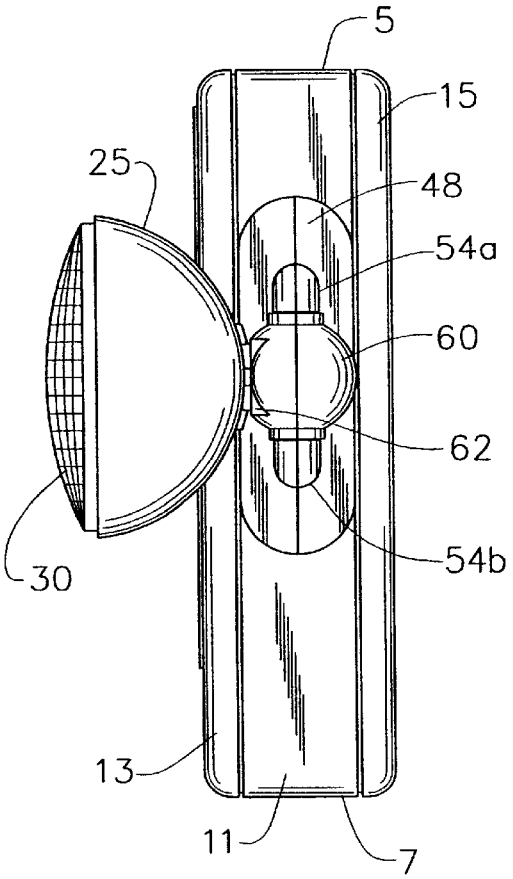
FIG. 5 is a right side view of the exit sign.
Figure 6:
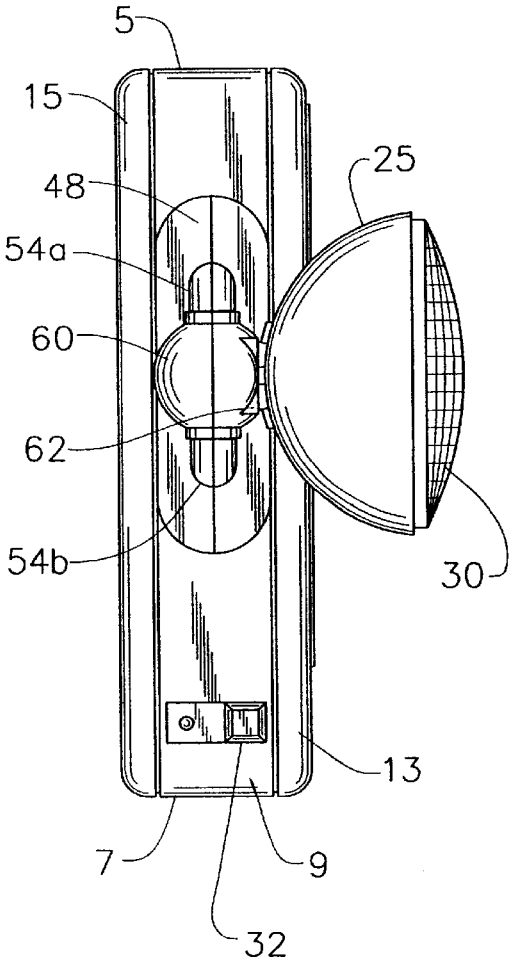
FIG. 6 is a left side view of the exit sign.

FIGS. 5 and 6 are side views of exit sign 1 with lighting head 25 in identical positions. Mounting flanges 48 are shown as oval planar members abutting left lateral side 9 and right lateral side 11 to ensure proper mounting of support assembly 27 to housing 3. Elongated recess 65 cannot be seen in these figures since recess 65 is on the surface of each lighting head 25 which points downward, and hence, is obscured from view. Button 32 is also more clearly depicted in FIG. 6. Button 32 is of a conventional design used in an emergency exit sign and, as a result, includes a depressible member for testing exit sign 1, in addition to a light for indicating various operational states of exit sign 1. However, the structure, configuration and operation of button 32 is not considered part of the present invention.

FIG. 7 is a partial exploded view of exit sign 1. In particular, light head 25 is removed from housing 3, to expose mounting recesses 80. A plurality of flexible insert flanges 83 are provided on mounting flange 48 which, when inserted into mounting recesses 80, lock support assembly 27 to housing 3. An identical set of mounting recesses 80 and insert flanges 83 are located on obscured lateral side 9 and support assembly 27, respectively. In a preferred embodiment, an additional mounting arrangement is located on top 5 of housing 3 to allow for the optional placement of a third support assembly 27 and a third lighting head 25 if desired. In the preferred embodiment shown, however, a cover 85 is provided because only two support assemblies 27 and lighting heads 25 are used.

FIGS. 8 and 9 show the potential for repositioning of each lighting head 25 along different axes. Specifically, lighting head 25 can be rotated about a first upright axis defined by support assembly 27 and, by moving head 25 relative to snap connector 62, lighting head 25 can be moved along another axis. The construction of support assembly 27 and joint element 60 are specifically designed to allow rotation of lighting head 25 through an angle greater than 180° (preferably about 220°–240°), as indicated by FIG. 8. This is accomplished, in part, by extending the length of laterally extending portions 54*a*, 54*b* of support arms 50*a*, 50*b*. By doing so, rotation of lighting head 25 is only limited by housing 3. Of course, longer and wider spaced support arms 50*a*, 50*b* could enable complete 360° rotation. However, as wiring for lighting head 25 is routed through one of support arms 50*a*, 50*b*, as will be discussed further below, complete rotation is not preferred. In any event, the solid lines indicate the position of lighting head 25 as shown in FIGS. 1–7, while the dotted lines are included to indicate a small sample of possible positions into which lighting head 25 may be rotated by joint element 60.

FIG. 9 shows the adjustment of lighting head 25 along the second axis. By shifting lighting head 25 relative to snap connector 62, lighting head 25 is moved along an arcuate path defined by elongated recess 65. Just as with FIG. 8, the solid lines indicate the position of lighting head 25 as shown in FIGS. 1–7, while the dotted lines are included to indicate a small sample of possible angular positions into which lighting head 25 may be shifted.

Figure 10:
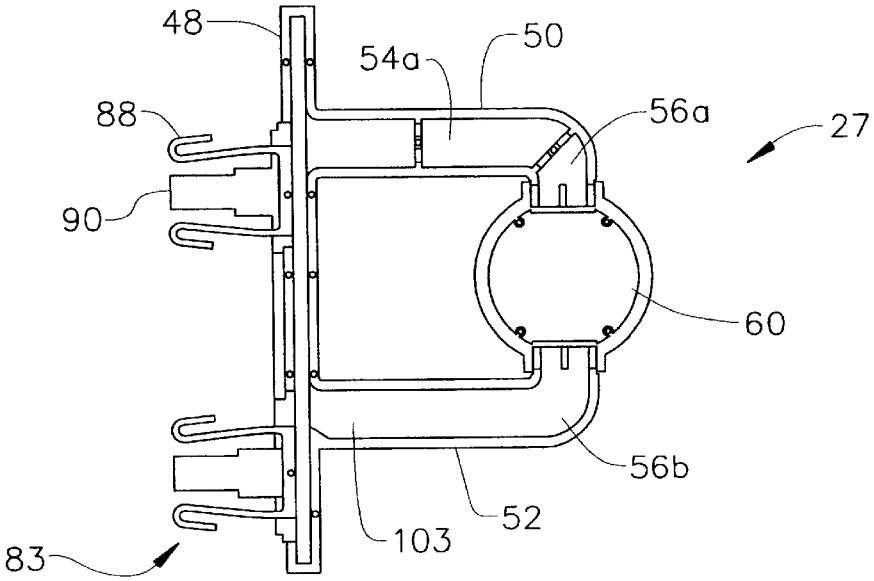
FIG. 10 is a cross-sectional view of a mounting assembly used between the housing of the exit sign and one of the lighting heads.
Figure 11:
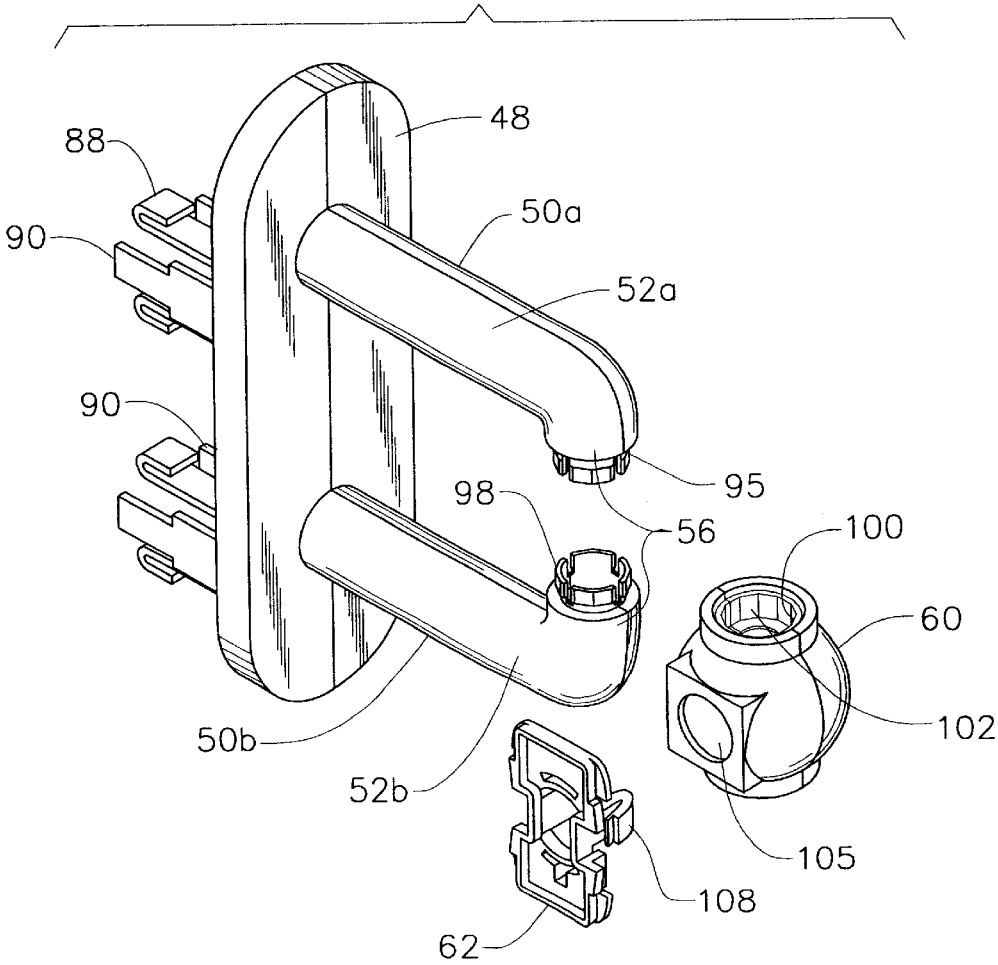
FIG. 11 is an exploded view of an overall support assembly used in interconnecting one lighting head to the exit sign housing.

FIGS. 10 and 11 detail the preferred structure of support assembly 27. On one side of mounting flange 48 are a pair of insert flanges 83. Each set of insert flanges 83 includes alternating hooks 88 and tabs 90, spaced apart and arranged in the general shape of a square. When support assembly 27 is completely assembled and joined to housing 3, hooks 88 and tabs 90 are inserted into mounting recess 80. Mounting recess 80 is constructed such that hooks 88 mate with part of mounting recesses 80, thereby preventing ready removal of insert flanges 83 from mounting recesses 80. Mounting flange 48 prevents insert flanges 83 from being inserted too far into housing 3. Therefore, the combination of hooks 88 and mounting flange 48 secures support assembly 27 to housing 3.

Support arms 50*a*, 50*b* are hollow and terminate adjacent a respective end 95 in external facets 98. Joint element 60 includes an aligned hole 100 with internal facets 102. When joint element 60 is placed between support arms 50*a*, 50*b*, a unitary bore or tunnel 103 is formed from one support arm 50a through joint element 60 to opposite support arm 50*b*. External facets 98 of each vertically extending portion 56*a*, 56*b* mate with internal facets 102 of joint element 60 to define a plurality of radial positions for joint element 60 with respect to housing 3. Due to the interaction of external facets 98 and internal facets 102, a freely rotatable joint is formed. However, this freely rotatable junction allows for a variety of supported positions for lighting head 25 without the need for loosening and tightening of mechanical fasteners to maintain relative positions. In addition, detents are defined by the mating of facets 98 and 102 to retain lighting head 25 in a desired position.

Joint element 60 also includes a lateral opening 105 which mates with snap connector 62. Snap connector 62 includes prongs 108 which are snap-fittingly inserted into lateral opening 105 to secure snap connector 62 to joint element 60 while permitting relative rotation. Therefore, lighting head 25 can rotate relative to joint element 60. Because snap connector 62 is provided with a central aperture, wires (not shown) can be routed from lighting head 25 through snap connector 62, joint element 60, one of support arms 50*a*, 50*b*, mounting flange 48 to housing 3. Mounting recess 80 may optionally be formed with an electrical socket (not shown), adapted to receive such wires.

Although described with reference to preferred embodiments, it should readily understood that various changes and/or modifications could be made to the invention without departing from the spirit thereof. For example, it is contemplated to provide only a single support arm 50*a* or 50*b*, to which lighting head 25 is connected. Additionally, the illumination source within lighting head 25 may be a halogen lamp or any other light source, instead of a traditional incandescent light bulb. Finally, mounting flange 48 may include a quick-connect plug, adapted to be inserted into a socket in proximity to mounting recess 80, to electrically connect the wires extending from lighting head 25 to housing 3. It must also be noted that relative terms such as top, bottom, left and right are included for ease of understanding, and are not to be considered as limiting with regards to the above-described invention. Instead, the invention is only intended to be limited by the scope of the following claims.

I claim:

1. An exit sign comprising:

a housing having a front face and a rear face with a peripheral edge therebetween, said housing being adapted to receive a lighting system including an illumination source and a power source;

symbols located on said front face adapted to be illuminated by the lighting system;

a support assembly mounted to said peripheral edge, said support assembly including a support arm defining a first axis;

a freely rotatable lighting head supported by said support arm for movement to any one of a plurality of selectable, discreet positions through an angle greater than 180° about the first axis; and means for enabling sliding adjustment of said lighting head relative to said support arm.

2. The exit sign according to claim 1, wherein said peripheral edge includes at least one mounting recess into which a portion of said support assembly projects.

3. The exit sign according to claim 2, wherein said support assembly includes means for snap-fittingly connecting the support assembly to the housing.

4. An exit sign comprising:

a housing having a front face and a rear face with a peripheral edge therebetween, said housing being adapted to receive a lighting system including an illumination source and a power source;

symbols located on said front face adapted to be illuminated by the lighting system;

a support assembly mounted to said peripheral edge, said support assembly including a support arm defining a first axis;

a freely rotatable lighting head supported by said support arm for movement to any one of a plurality of selectable, discreet positions through an angle greater than 180° about the first axis;

a joint element attached to the support assembly for rotation about the first axis; and a connector attached to the joint element for rotation about a second axis, said lighting head being attached to the connector such that the lighting head is supported by the support arm through the joint element and the connector, wherein said lighting head is provided with an elongated recess into which the connector projects such that the lighting head is slidable relative to the connector.

5. The exit sign according to claim 4, wherein the connector is snap-fittingly attached to the joint element.

6. The exit sign according to claim 4, wherein said second axis of rotation is substantially perpendicular to the first axis.

7. The exit sign according to claim 4, wherein said support arm includes a terminal end, remote from the housing, provided with a first set of facets, and the joint element is provided with a second set of facets, wherein the first and second sets of facets mate to define the plurality of selectable, discreet positions.

8. The exit sign according to claim 7, wherein the first set of facets are provided on an external surface portion of said support arm and the second set of facets are provided on an internal surface portion of said joint element.

9. The exit sign according to claim 4, wherein said lighting head includes a curved surface, said elongated recess extending across a substantial portion of said curved surface such that movement of said lighting head relative to said connector constitutes rotation of said lighting head about a third axis.

10. The exit sign according to claim 4, wherein said support arm, said joint element and said connector collectively define a tunnel from said housing to said lighting head, said tunnel being adapted to receive wires extending from said lighting head to said housing.

11. An exit sign comprising:

a housing having a front face and a rear face with a peripheral edge therebetween, said housing being adapted to receive a lighting system including an illumination source and a power source;

symbols located on said front face adapted to be illuminated by the lighting system;

a support assembly mounted to said peripheral edge, said support assembly including a support arm defining a first axis;

a lighting head; and means for attaching the lighting head to the support assembly for rotation about first, second and third distinct axes, while permitting adjustment of said lighting head about the first axis through an angle greater than 180°, wherein said attaching means comprises a joint element attached to the support assembly for rotation about the first axis and a connector attached to the joint element for rotation about the second axis, said lighting head being directly attached to the connector for movement about the third axis, wherein said lighting head is provided with an elongated recess into which the connector projects such that the lighting head is slidable relative to the connector.

12. The exit sign according to claim 11, wherein said peripheral edge includes at least one mounting recess into which a portion of said support assembly projects.

13. The exit sign according to claim 11, wherein said support arm includes a terminal end, remote from the housing, provided with a first set of facets, and the joint element is provided with a second set of facets, wherein the first and second sets of facets mate to define a plurality of selectable, discreet positions for said lighting head.

14. The exit sign according to claim 11, wherein said support arm, said joint element and said connector collectively define a tunnel from said housing to said lighting head, said tunnel being adapted to receive wires extending from said lighting head to said housing.

* * * * *